US008960139B2

(12) United States Patent
Metcalf et al.

(10) Patent No.: US 8,960,139 B2
(45) Date of Patent: Feb. 24, 2015

(54) ENGINE ASSEMBLY HAVING CAMSHAFT WITH NON-MAGNETIC JOURNAL

(75) Inventors: Richard L. Metcalf, Okemos, MI (US); Robert Lionel Jacques, Troy, MI (US); Mark Stabinsky, Troy, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 1211 days.

(21) Appl. No.: 12/567,102

(22) Filed: Sep. 25, 2009

(65) Prior Publication Data

US 2011/0073054 A1 Mar. 31, 2011

(51) Int. Cl.

| | |
|---|---|
| ***F01L 1/34*** | (2006.01) |
| ***F01L 1/047*** | (2006.01) |
| *F01L 1/14* | (2006.01) |
| *F01L 1/344* | (2006.01) |

(52) U.S. Cl.

CPC ..... *F01L 1/047* (2013.01); *F01L 1/146* (2013.01); *F01L 1/344* (2013.01); *F01L 2001/0473* (2013.01); *F01L 2001/0476* (2013.01); *F01L 2101/00* (2013.01); *F01L 2820/041* (2013.01)

USPC ..... 123/90.17; 123/90.31

(58) Field of Classification Search

USPC ..... 123/90.15, 90.17, 90.31

See application file for complete search history.

(56) References Cited

U.S. PATENT DOCUMENTS

| | | | | |
|---|---|---|---|---|
| 6,343,580 | B2 * | 2/2002 | Uchida | 123/90.17 |
| 7,284,517 | B2 * | 10/2007 | Lancefield et al. | 123/90.17 |
| 2003/0194343 | A1 * | 10/2003 | Craig | 420/35 |
| 2009/0276145 | A1 * | 11/2009 | Schafer et al. | 701/105 |

FOREIGN PATENT DOCUMENTS

JP 2004309304 A * 11/2004

OTHER PUBLICATIONS

Abstract of JP2004309304A; Nov. 2004.*

* cited by examiner

*Primary Examiner* — Zelalem Eshete

(74) *Attorney, Agent, or Firm* — Harness, Dickey & Pierce, P.L.C.

(57) ABSTRACT

An engine assembly may include an engine structure, a camshaft, a timing wheel and a camshaft position sensor. The camshaft may be rotationally supported within the engine structure and may have a non-magnetic journal rotationally fixed thereto. The timing wheel may be rotationally fixed to the camshaft proximate the non-magnetic journal. The camshaft position sensor may be coupled to the engine structure and configured to determine the rotational position of the camshaft based on a magnetic impulse from the timing wheel.

20 Claims, 2 Drawing Sheets

ENGINE ASSEMBLY HAVING CAMSHAFT WITH NON-MAGNETIC JOURNAL

FIELD

The present disclosure relates to engine assemblies, and more specifically to engine camshaft assemblies having timing wheels.

BACKGROUND

This section provides background information related to the present disclosure which is not necessarily prior art.

Internal combustion engines include one or more camshafts for actuation of intake and exhaust valves. Engines may additionally include a cam phaser to adjust valve timing. Engines including cam phasers may include timing wheels to determine the rotational position of the camshaft during operation. The timing wheels may have a magnetic permeability that is determined by a sensor to determine rotational position of the camshaft. However, the timing wheel may require axial spacing from the camshaft journals to prevent magnetic journals from affecting the position reading by the sensor.

SUMMARY

An engine assembly may include an engine structure, a camshaft, a timing wheel and a camshaft position sensor. The camshaft may be rotationally supported within the engine structure and may have a non-magnetic journal rotationally fixed thereto. The timing wheel may be rotationally fixed to the camshaft proximate the non-magnetic journal. The camshaft position sensor may be coupled to the engine structure and configured to determine the rotational position of the camshaft based on a magnetic impulse from the timing wheel.

A camshaft assembly may include a first shaft, a non-magnetic journal and a magnetic timing wheel. The non-magnetic journal may be rotationally fixed to the first shaft. The magnetic timing wheel may be located on the first shaft proximate the non-magnetic journal.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only and are not intended to limit the scope of the present disclosure in any way.

Corresponding reference numerals indicate corresponding parts throughout the several views of the drawings.

DETAILED DESCRIPTION

Examples of the present disclosure will now be described more fully with reference to the accompanying drawings. The following description is merely exemplary in nature and is not intended to limit the present disclosure, application, or uses.

Figure 1:
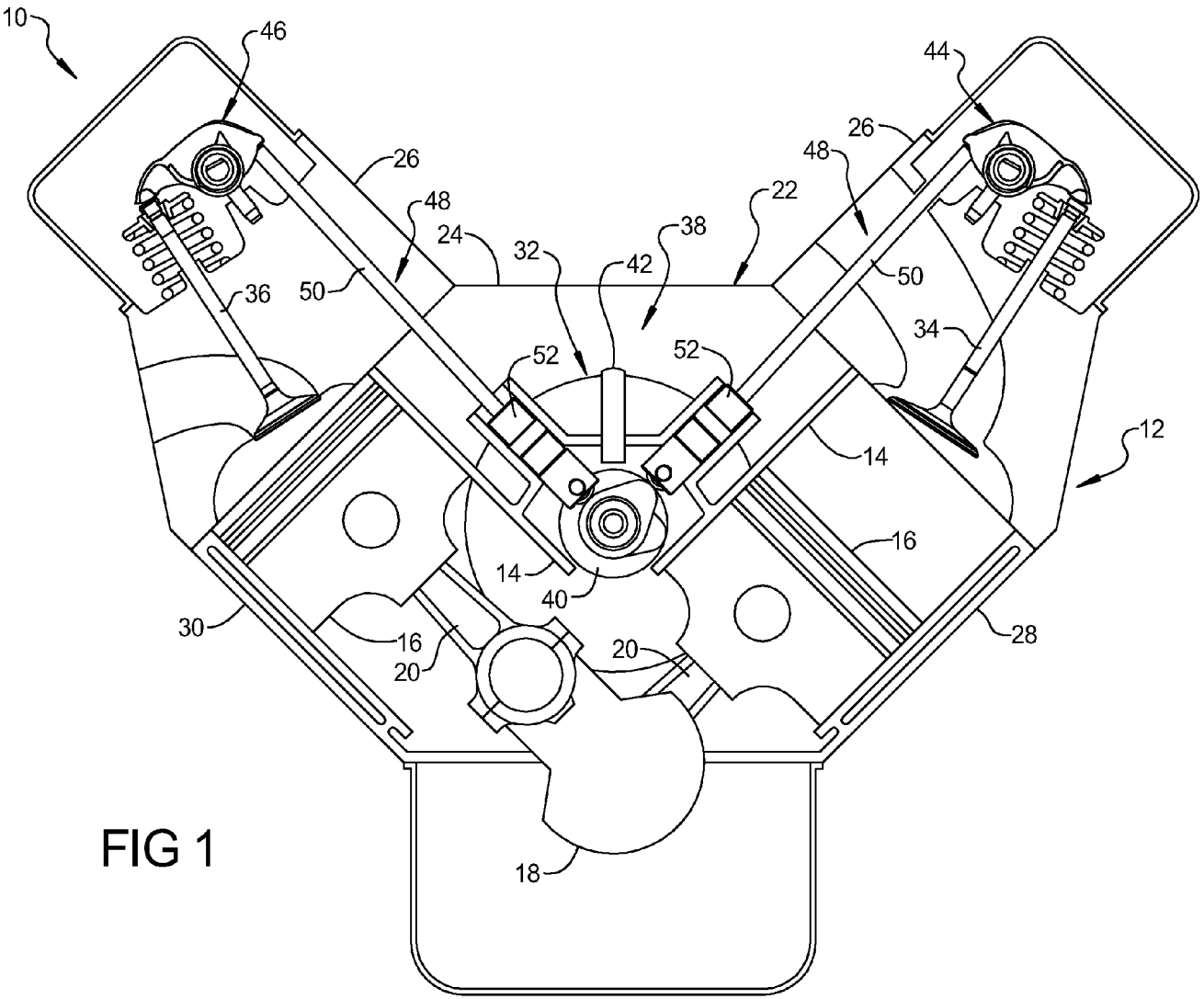
FIG. 1 is schematic illustration of an engine assembly according to the present disclosure.

With reference to FIG. 1, an engine assembly 10 is illustrated. The engine assembly 10 may include a cam-in-block design having a V-configuration. While a cam-in-block design is illustrated, it is understood that the present disclosure additionally applies to various other engine configurations including, but not limited to, overhead cam engines. The engine assembly 10 may include an engine structure 12 defining cylinders 14, pistons 16 disposed within the cylinders 14, a crankshaft 18, connecting rods 20 coupling the pistons 16 to the crankshaft 18, and a valvetrain assembly 22. The engine structure 12 may include an engine block 24 and cylinder heads 26.

The engine block 24 may define first and second banks 28, 30 of cylinders 14 disposed at an angle relative to one another. The cylinder heads 26 may be mounted to the engine block 24 above the cylinders 14. While FIG. 1 illustrates the first and second banks 28, 30 disposed at an angle relative to one another, it is understood that the present disclosure is not limited to engines having a V-configuration.

The valvetrain assembly 22 may include a cam phaser 32, intake and exhaust valves 34, 36, a valve actuation assembly 38, a camshaft 40, and a camshaft position sensor 42. The valve actuation assembly 38 may include intake and exhaust rocker arm assemblies 44, 46 and valve lift mechanisms 48. Each of the intake rocker arm assemblies 44 may be engaged with an intake valve 34 and may be coupled to the engine structure 12, and more specifically may be coupled to the cylinder head 26. A first end of the intake rocker arm assembly 44 may be engaged with the intake valve 34 and a second end may be engaged with a first end of the valve lift mechanism 48.

Each of the exhaust rocker arm assemblies 46 may be engaged with an exhaust valve 36 and may be coupled to the engine structure 12, and more specifically may be coupled to the cylinder head 26. A first end of the exhaust rocker arm assembly 46 may be engaged with the exhaust valve 36 and a second end may be engaged with a first end of the valve lift mechanism 48. The valve lift mechanism 48 may include a pushrod 50 and a lifter 52.

Figure 2:
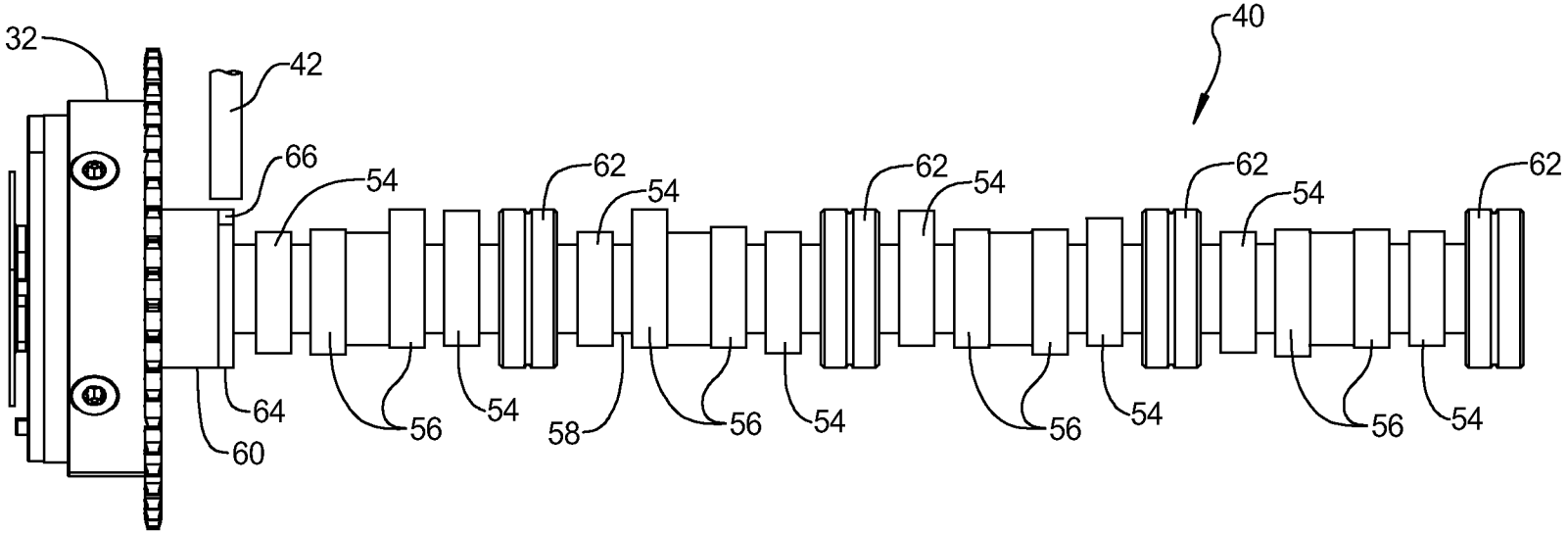
FIG. 2 is an illustration of the camshaft assembly shown in FIG. 1.

With additional reference to FIG. 2, the camshaft 40 may include first and second sets of lobes 54, 56, a first shaft 58, a second shaft (not shown), a first journal 60, second journals 62, and a timing wheel 64. The second shaft may be located within the first shaft 58 and rotatable relative thereto. The first shaft 58 and the second shaft may each be coupled to the cam phaser 32 and may be rotated relative to one another. The first set of lobes 54 may be rotationally fixed to the first shaft 58 and the second set of lobes 56 may be rotationally fixed to the second shaft. By way of non-limiting example, the first set of lobes 54 may include intake lobes and the second set of lobes 56 may include exhaust lobes. Alternatively, the first set of lobes 54 may include exhaust lobes and the second set of lobes 56 may include intake lobes. The present disclosure additionally applies to camshafts including only intake or exhaust lobes (i.e., dual overhead camshaft arrangements).

The first journal 60 and second journals 62 may be rotationally fixed to the first shaft 58. The first journal 60 may be located at a first end of the camshaft 40 adjacent the cam phaser 32. The second journals 62 may be located along the first shaft 58 between the first journal 60 and a second end of the camshaft 40 opposite the first end. First and second lobes 54, 56 may be located between the first journal 60 and an adjacent second journal 62, as well as between adjacent pairs of second journals 62.

The timing wheel 64 may be located axially between the first and second journals 60, 62. By way of non-limiting example, the timing wheel may be located within 6 millimeters (mm) of the first journal 60. More specifically, the timing wheel 64 may abut an axial end face of the first journal 60. The timing wheel 64 may include recesses 66. The timing wheel 64 may have a magnetic permeability that is sensed by the camshaft position sensor 42. The magnetic permeability of the timing wheel 64 varies at the recesses 66, providing for determination of the rotational orientation of the camshaft 40 by the camshaft position sensor 42 during engine operation.

In order to accommodate the positioning of the timing wheel 64 on the camshaft 40, the first journal 60 may be non-magnetic. By way of non-limiting example, the first journal 60 may be formed from a non-magnetic material such as austenitic manganese steel (i.e., Hadfield steel). Alternatively, the first journal 60 may be formed from other steels and demagnetized after machining of the journal is completed. Providing the first journal 60 free from magnetic charge allows the placement of the timing wheel 64 discussed above while preventing the first journal 60 from influencing the magnetic impulses sensed by the camshaft position sensor 42.

What is claimed is:

1. An engine assembly comprising:

an engine structure;

a camshaft rotationally supported within the engine structure and having a non-magnetic journal rotationally fixed thereto;

a timing wheel rotationally fixed to the camshaft proximate the non-magnetic journal; and a camshaft position sensor coupled to the engine structure and configured to determine the rotational position of the camshaft based on a magnetic impulse from the timing wheel.

2. The engine assembly of claim 1, wherein the non-magnetic journal is formed from austenitic Hadfield steel.

3. The engine assembly of claim 1, wherein the timing wheel is within 6 millimeters of the non-magnetic journal.

4. The engine assembly of claim 3, wherein the timing wheel abuts the non-magnetic journal.

5. The engine assembly of claim 1, further comprising a cam phaser coupled to the camshaft and configured to adjust the rotational position of the camshaft during engine operation.

6. The engine assembly of claim 5, wherein the camshaft includes first and second lobes rotatable relative to one another during engine operation.

7. The engine assembly of claim 5, wherein the timing wheel is located at an end of the camshaft proximate the cam phaser.

8. The engine assembly of claim 1, wherein the camshaft includes first and second lobes rotatable relative to one another during engine operation.

9. The engine assembly of claim 1, wherein the camshaft includes an additional journal axially spaced from the non-magnetic journal, the timing wheel being located axially between the non-magnetic journal and the additional journal.

10. The engine assembly of claim 9, wherein the camshaft includes a cam lobe located axially between the non-magnetic journal and the additional journal.

11. A camshaft assembly comprising:

a first shaft;

a non-magnetic journal rotationally fixed to the first shaft; and a magnetic timing wheel located on the first shaft proximate the non-magnetic journal.

12. The camshaft assembly of claim 11, wherein the non-magnetic journal is formed from austenitic Hadfield steel.

13. The camshaft assembly of claim 11, wherein the timing wheel is within 6 millimeters of the non-magnetic journal.

14. The camshaft assembly of claim 13, wherein the timing wheel abuts the non-magnetic journal.

15. The camshaft assembly of claim 11, further comprising a cam phaser coupled to the first shaft and configured to adjust the rotational position of the first shaft during engine operation.

16. The camshaft assembly of claim 15, further comprising first and second lobes located on the first shaft and rotatable relative to one another during engine operation.

17. The camshaft assembly of claim 15, wherein the timing wheel is located at an end of the camshaft proximate the cam phaser.

18. The camshaft assembly of claim 11, further comprising first and second lobes located on the first shaft and rotatable relative to one another during engine operation.

19. The camshaft assembly of claim 11, further comprising an additional journal axially spaced from the non-magnetic journal, the timing wheel being located axially between the non-magnetic journal and the additional journal.

20. The camshaft assembly of claim 11, further comprising a cam lobe located axially between the non-magnetic journal and the additional journal.

* * * * *